US008733683B2

(12) United States Patent
Mantovan et al.

(10) Patent No.: US 8,733,683 B2
(45) Date of Patent: May 27, 2014

(54) MACHINE FOR WINDING A WIRE FROM A ROLLING MILL INTO A COIL WITH IMPROVED MEANS FOR LOCKING THE WIRE TAIL END AND CONTAINING THE COIL FORMED

(75) Inventors: Gianfranco Mantovan, Busto Arsizio (IT); Remo Tiziani, Castellanza (IT)

(73) Assignee: Siemens S.p.A., Milan (IT)

( * ) Notice: Subject to any disclaimer, the term of this patent is extended or adjusted under 35 U.S.C. 154(b) by 614 days.

(21) Appl. No.: 13/056,693

(22) PCT Filed: Jul. 8, 2009 (Under 37 CFR 1.47)

(86) PCT No.: PCT/EP2009/058644

§ 371 (c)(1), (2), (4) Date: Mar. 24, 2011

(87) PCT Pub. No.: WO2010/012575

PCT Pub. Date: Feb. 4, 2010

(65) Prior Publication Data

US 2012/0025000 A1 Feb. 2, 2012

(30) Foreign Application Priority Data

Jul. 29, 2008 (IT) ..... MI2008A1389

(51) Int. Cl.
*B21C 47/24* (2006.01)

(52) U.S. Cl.
USPC ..... 242/362.3; 242/472.5; 242/473.7

(58) Field of Classification Search
CPC ..... B21C 47/04; B21C 47/326; B21C 47/24
USPC ..... 242/360, 362, 362.1, 362.2, 362.3, 363, 242/472.5, 473.4, 473.5, 473.6, 473.7, 242/473.8, 473.9, 474.3, 474.4
See application file for complete search history.

(56) References Cited

U.S. PATENT DOCUMENTS

| | | | | |
|---|---|---|---|---|
| 1,605,281 | A * | 11/1926 | Reece | 242/362 |
| 3,861,615 | A * | 1/1975 | Kinnicutt, Jr. | 242/361.1 |
| 3,926,382 | A | 12/1975 | Sieurin et al. | |
| 5,544,828 | A | 8/1996 | Winkler et al. | |
| 2006/0053860 | A1 | 3/2006 | Peter et al. | |

FOREIGN PATENT DOCUMENTS

| | | | |
|---|---|---|---|
| CN | 1082505 | A | 2/1994 |
| CN | 1735469 | A | 2/2006 |
| CN | 1984731 | A | 6/2007 |
| CN | 101128378 | A | 2/2008 |
| RU | 2101112 | C1 | 1/1998 |
| RU | 2006136037 | A | 4/2008 |
| WO | 2004/108314 | A1 | 12/2004 |
| WO | 2004108315 | A1 | 12/2004 |
| WO | 2004108316 | A1 | 12/2004 |
| WO | 2004108317 | A1 | 12/2004 |

* cited by examiner

*Primary Examiner* — William E Dondero
(74) *Attorney, Agent, or Firm* — Laurence A. Greenberg; Werner H. Stemer; Ralph E. Locher

(57) ABSTRACT

A machine for winding a wire coming from a rolling mill into a coil, includes first means for locking a tail end of the wire and second means for containing, lifting and moving a formed coil to a binding station. The first means for locking the tail end of the wire and the second means for containing, lifting and moving the formed coil are built into a single operating unit.

10 Claims, 16 Drawing Sheets

MACHINE FOR WINDING A WIRE FROM A ROLLING MILL INTO A COIL WITH IMPROVED MEANS FOR LOCKING THE WIRE TAIL END AND CONTAINING THE COIL FORMED

Machine for winding a wire from a rolling mill into a coil with improved means for locking the wire tail end and containing the coil formed

BACKGROUND OF THE INVENTION

Field of the Invention

This invention relates to a machine for winding a wire from a rolling mill into a coil with improved means for locking the wire tail end and containing the coil formed.

As is well known by persons skilled in the art, the wire from a rolling mill has to be wound on commercial-weight coils, that are then individually bound by strapping and placed in storage.

For this purpose, downstream of the wire stabilization cooling system there are usually two winding machines to which the wire is fed—alternately—using a diverter.

The two winding machines therefore work alternately, i.e. while the coil is being created on one, a completed coil is removed and taken from the other to the binding station. Machines and plant of this type are for example described and illustrated in patent applications PCT WO2004/108314A, WO2004/108315A, WO2004/108316A, WO2004/108317A, WO2005/084843A, to which reference should be made, by way of example, if any general clarification is required regarding the technical field in question.

One of the most significant technical issues to be overcome when building these winding machines relates to locking the wire tail end in place against the coil formed on the spindle, and containing the coil itself when it is being lifted (removed) from the spindle, and moved to the binding station using strapping machines.

For this purpose it is known to use wire-tail-end locking rollers that are installed in a stationary position in the winding zone of the coil, laterally and radially in relation to the spindle.

Alternatively, containment of the coil during lifting and moving phases is provided by substantially static additional means of the fork system that engage the coil, while the wire-tail-end locking rollers are still operational. After this, these latter are removed and the coil can be removed from the spindle.

As a result, accessing the machine to perform any type of operation is difficult and the cycle times are long, involving numerous operating sequences on the two different systems involved in the operation, i.e. a first wire-tail-end locking system, fixed to the floor around the spindle, and a second coil containment system formed by the configuration of the mobile forks that remove it from the spindle and move it to the binding station.

BRIEF SUMMARY OF THE INVENTION

The general scope of this invention is to eliminate the issues in the prior art summarized above, creating a machine that incorporates a single system for locking the wire tail end and containing the coil formed, which is located outside the access zone of the machine, which as a result is entirely unencumbered. More specifically, the scope of the invention is achieved by a machine with the features set out in the main claim and the sub-claims attached.

BRIEF DESCRIPTION OF THE SEVERAL VIEWS OF THE DRAWING

The structural and functional features of the winding machine according to the invention, and its advantages compared to the prior art, will become even more evident by examining the description below, which refers to the schematic drawings attached, which illustrate a sample practical implementation of the invention. In the drawings.

DESCRIPTION OF THE INVENTION

Figure 2:
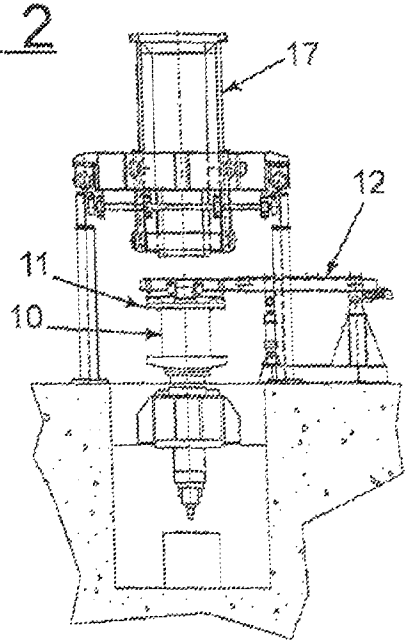
FIGS. 1, 2 and 3 are respectively longitudinal sections, cross sections, and plan views showing the machine in the coil formation phase.
Figure 1:
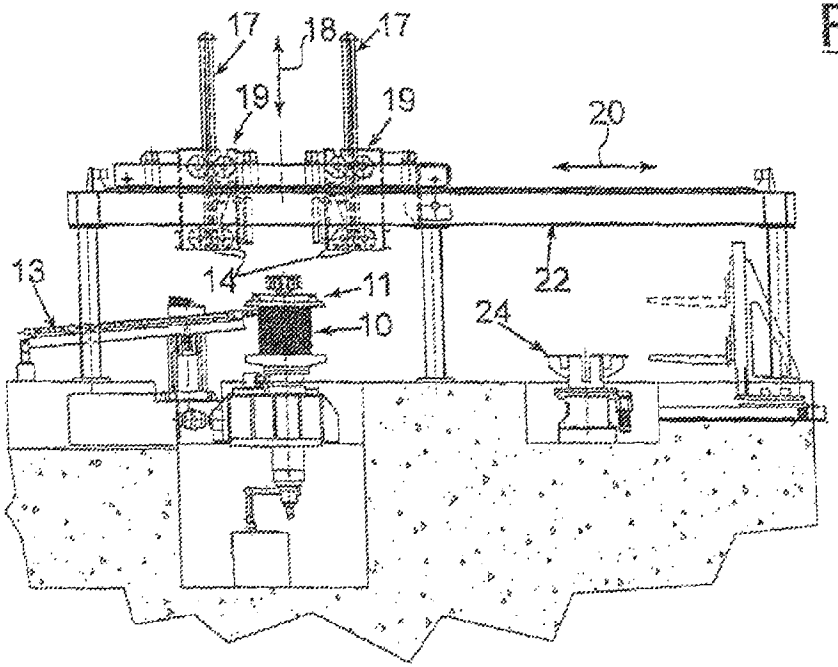
Figure 3:
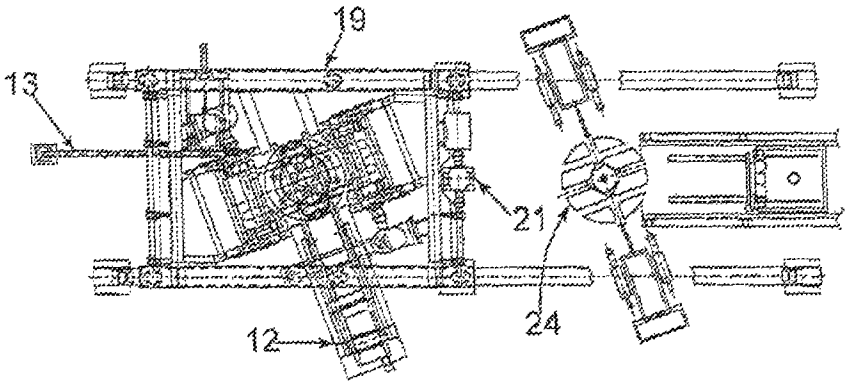
Figure 5:
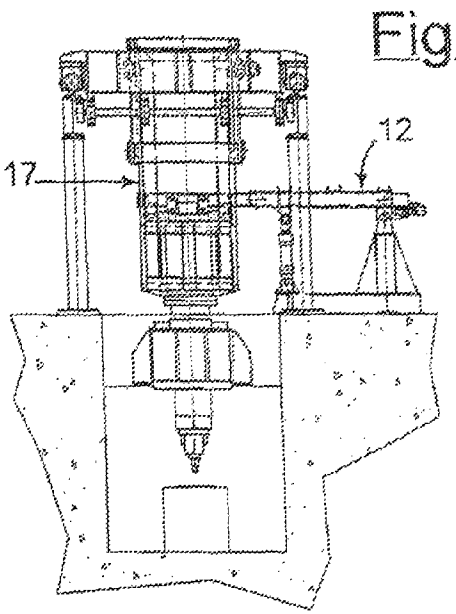
FIGS. 4, 5 and 6 are respectively longitudinal sections, cross sections, and plan views showing the machine in the final coil-winding phase.
Figure 4:
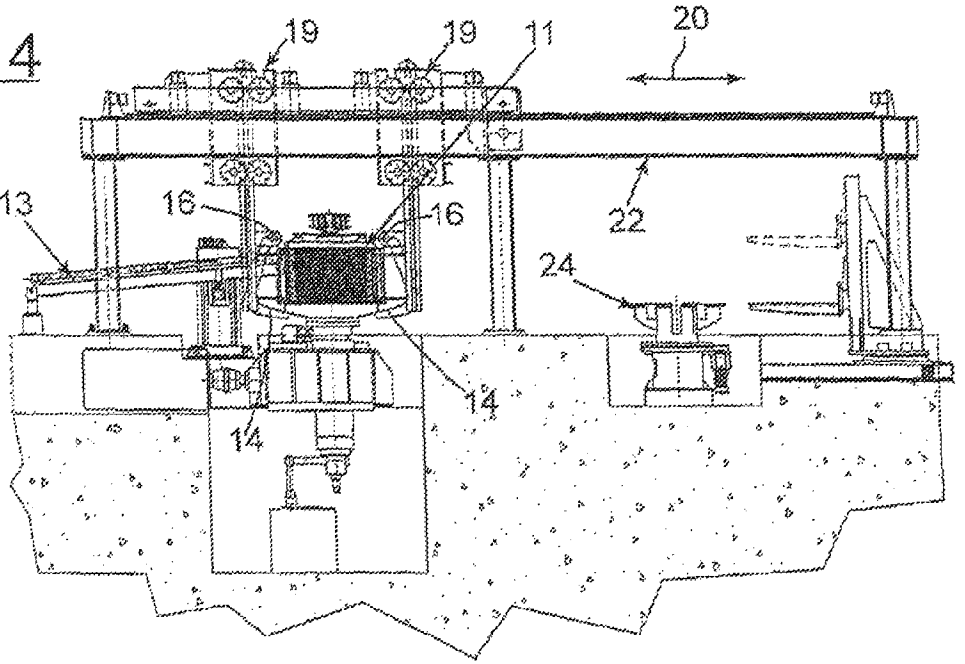
Figure 6:
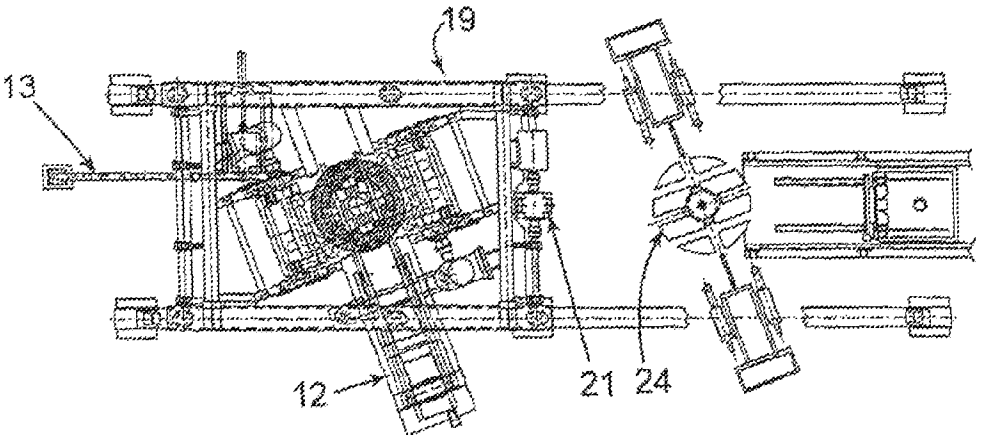
Figure 8:
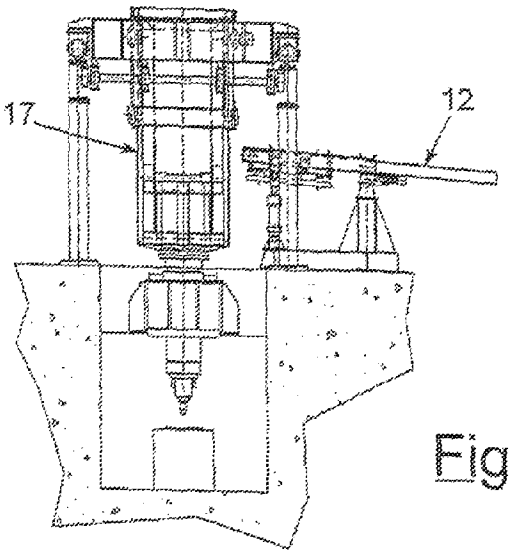
FIGS. 7, 8 and 9 are respectively longitudinal sections, cross sections, and plan views showing the machine in the cover removal phase and the start of the winding-zone coil removal phase.
Figure 9:
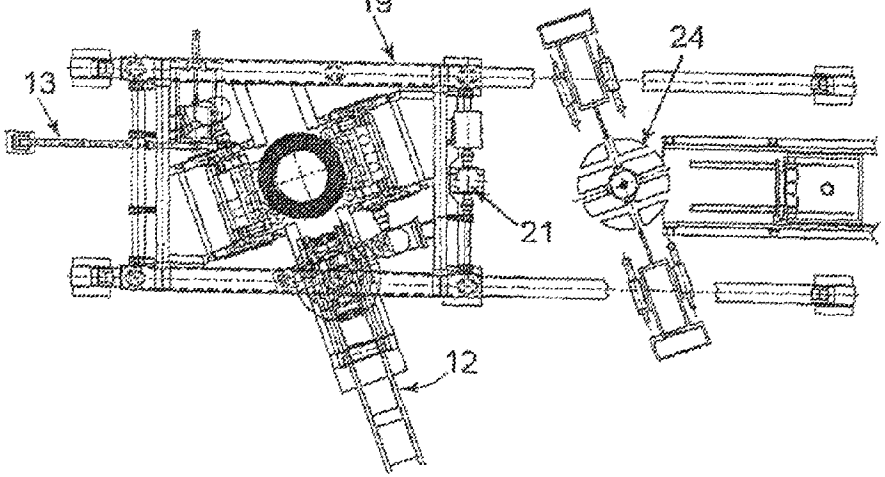
Figure 7:
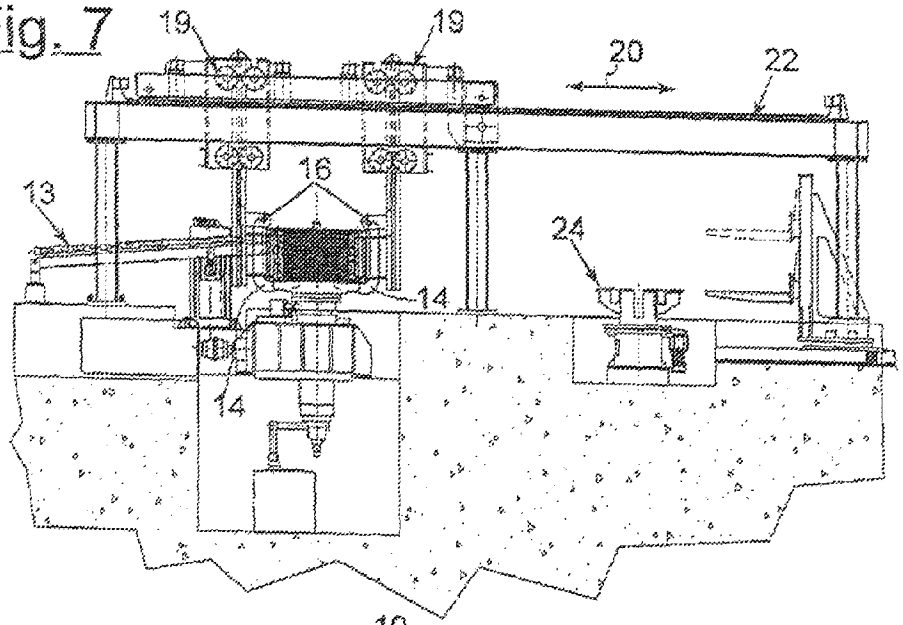
Figure 11:
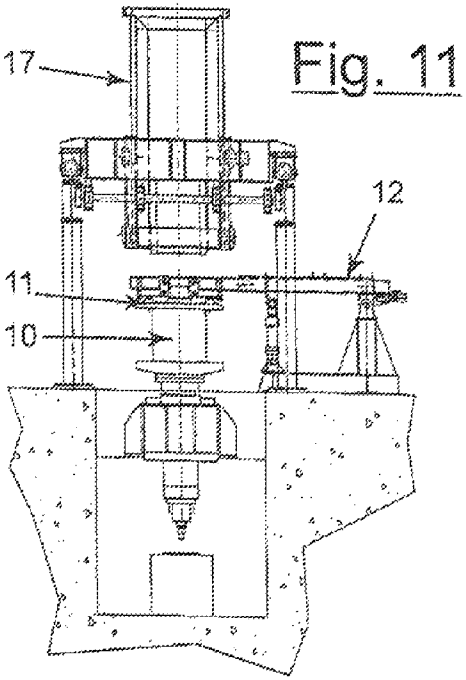
FIGS. 10, 11 and 12 are respectively longitudinal sections, cross sections, and plan views showing the machine in the coil lifting phase.
Figure 10:
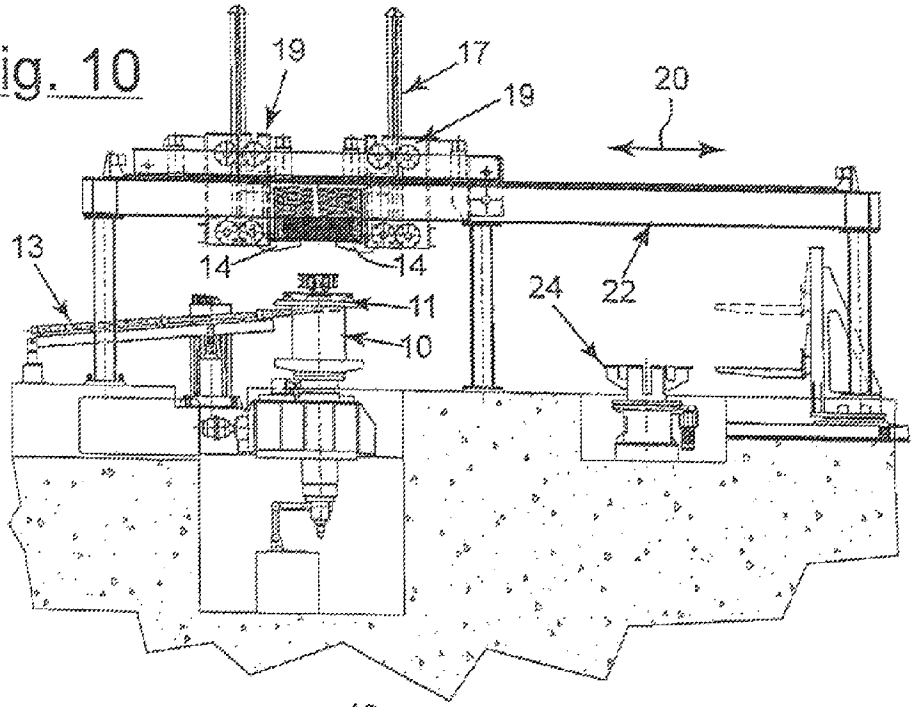
Figure 12:
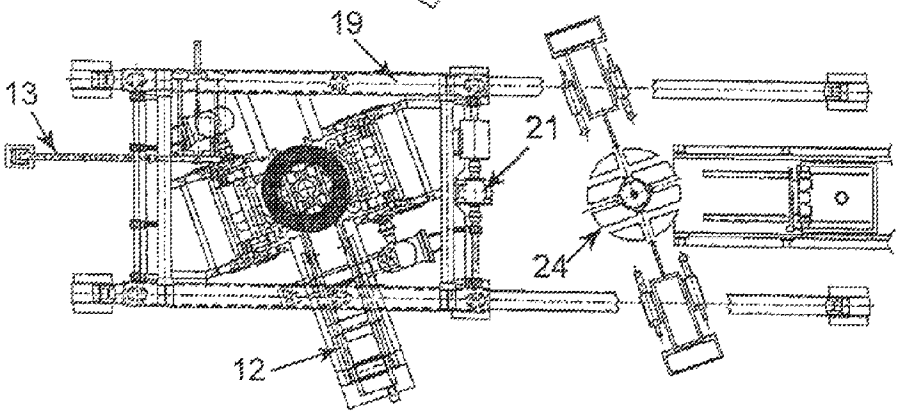
Figure 13:
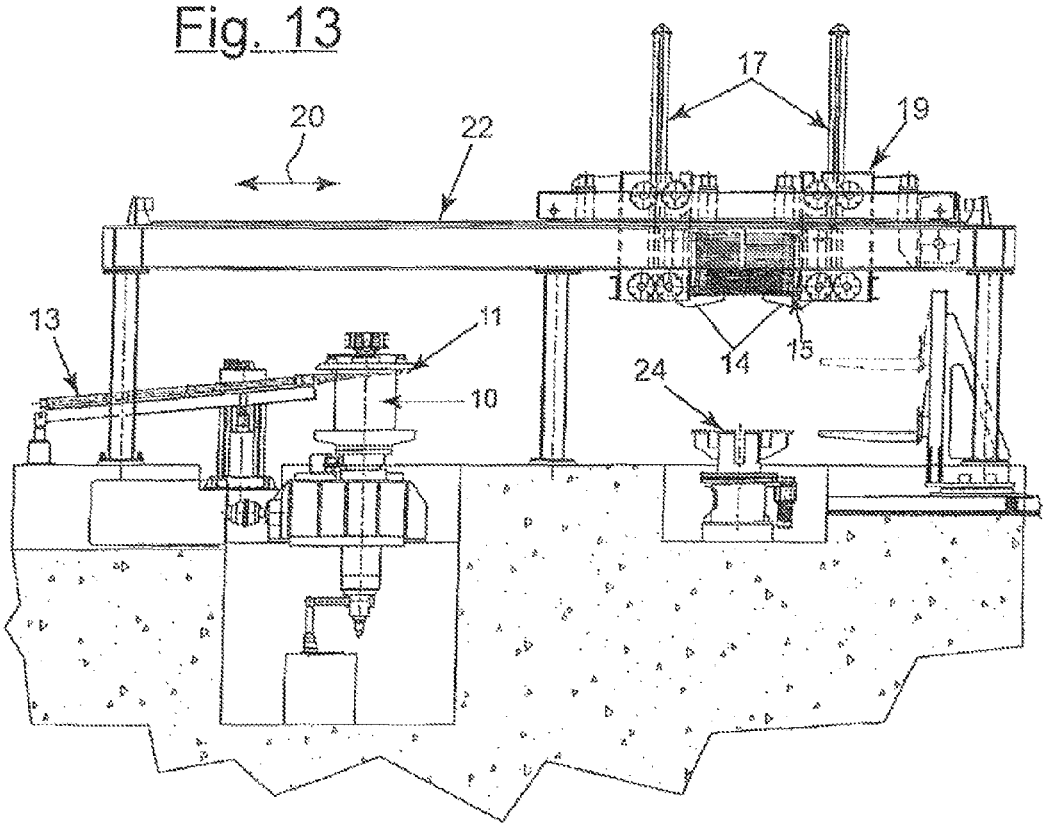
FIGS. 13, 14 are respectively longitudinal sections and plan views showing the machine in the coil moving phase.
Figure 14:
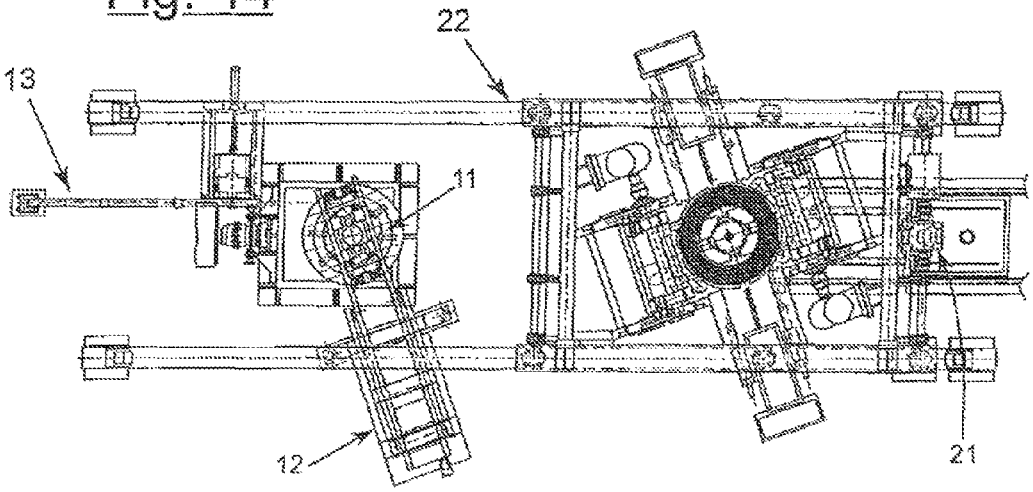
Figure 15:
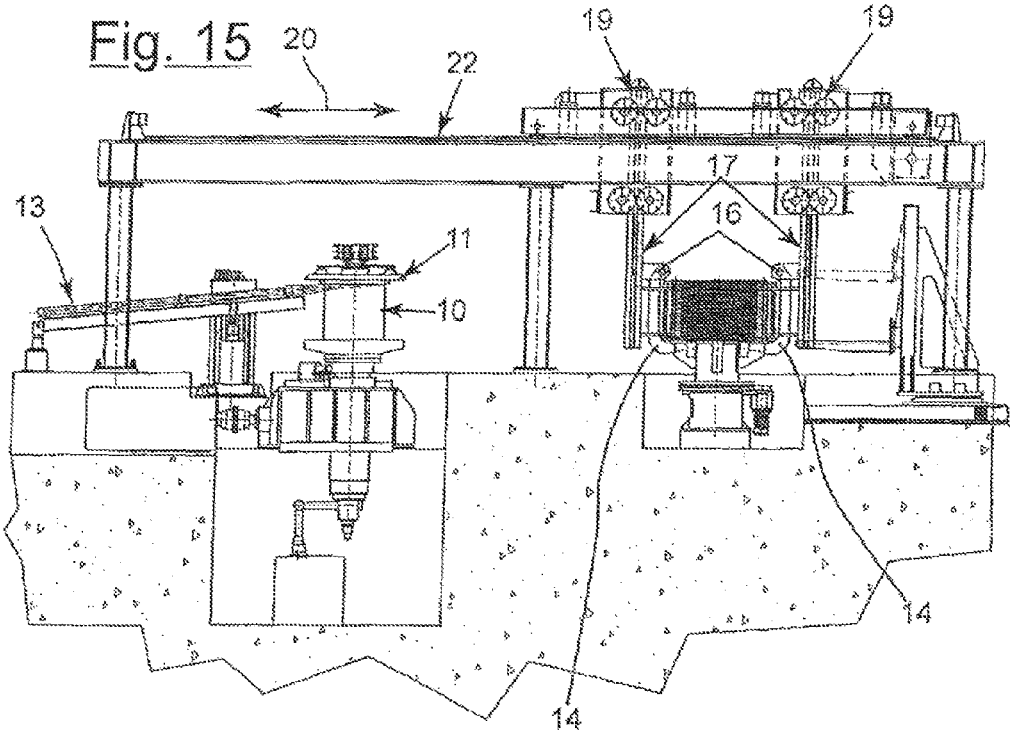
FIGS. 15, 16 are respectively longitudinal sections and plan views showing the machine in the coil binding-zone-depositing phase.
Figure 16:
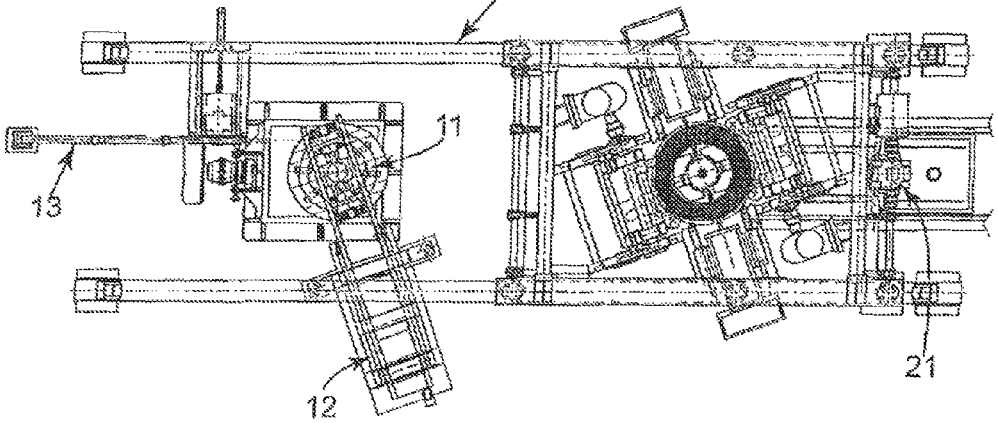
Figure 17:
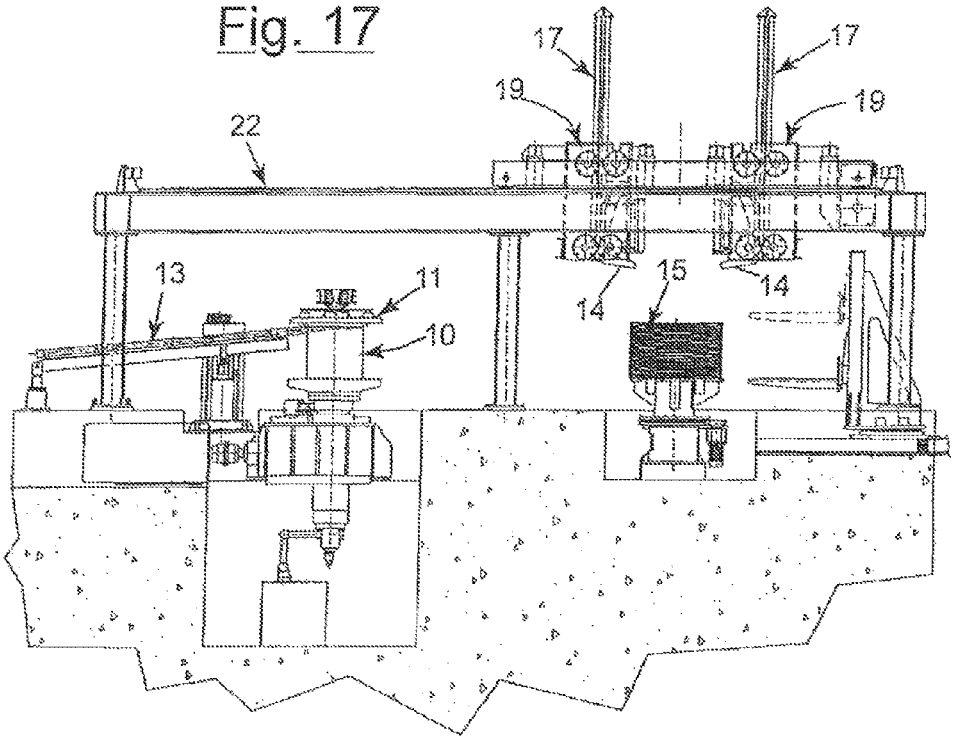
FIGS. 17, 18 are respectively longitudinal sections and plan views showing the machine in the fork-unit lifting phase.
Figure 18:
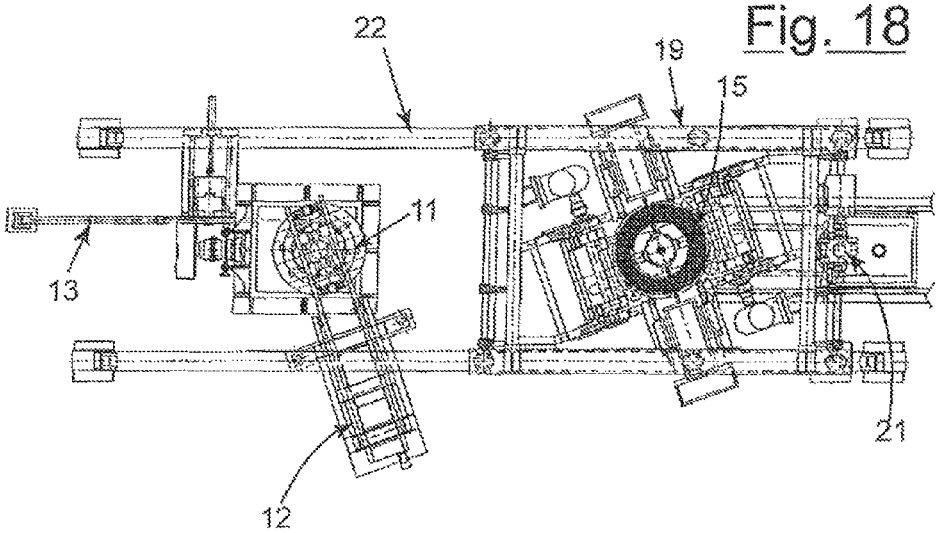
Figure 19:
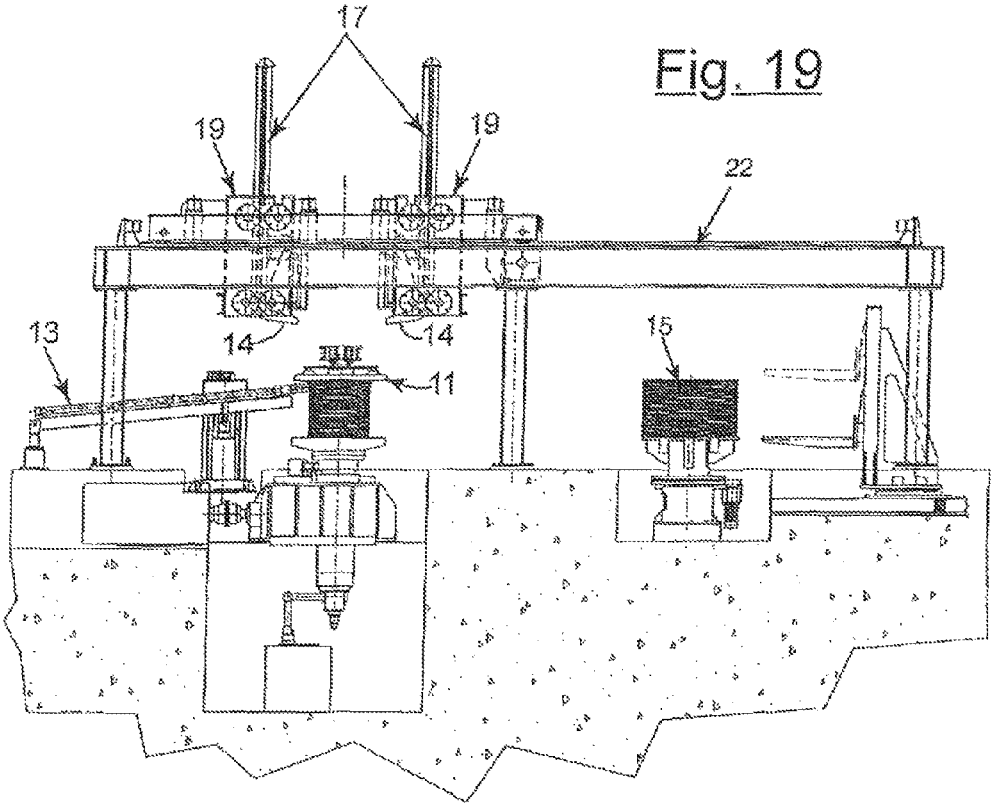
FIGS. 19, 20 are respectively longitudinal sections and plan views showing the machine in the binding phase start phase.
Figure 20:
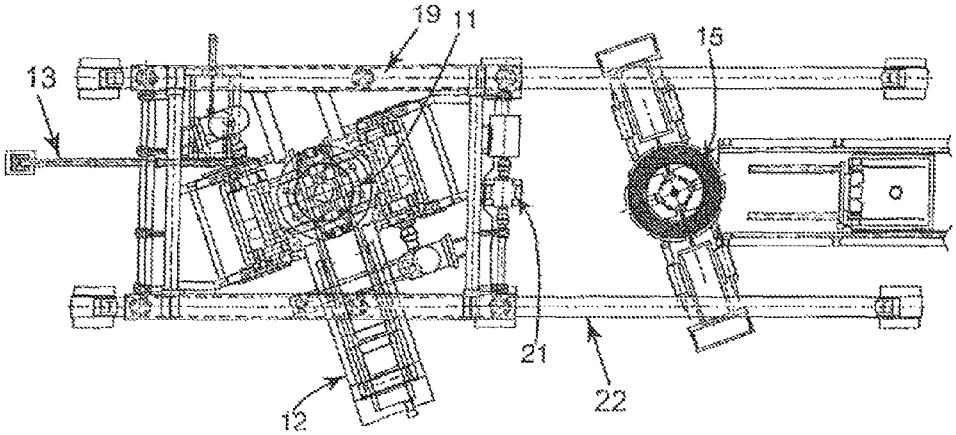
Figure 21:
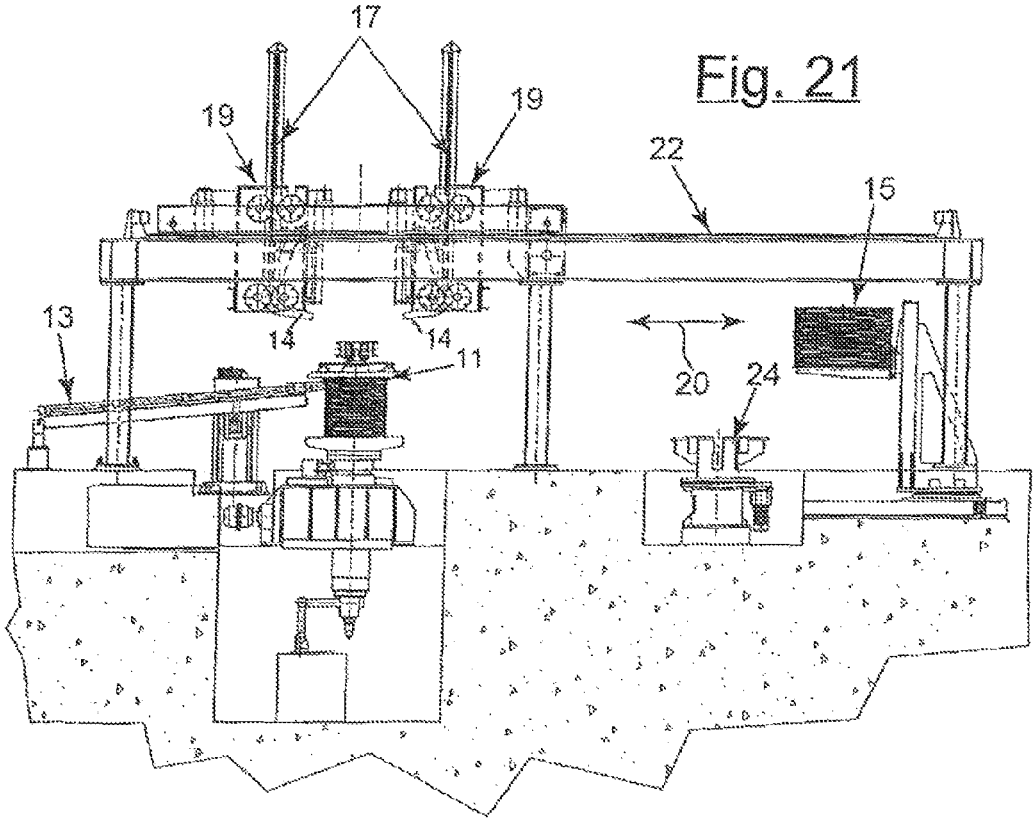
FIGS. 21, 22 are respectively longitudinal sections and plan views showing the machine in the binder position return phase, and the beginning of the bound-coil removal phase.
Figure 22:
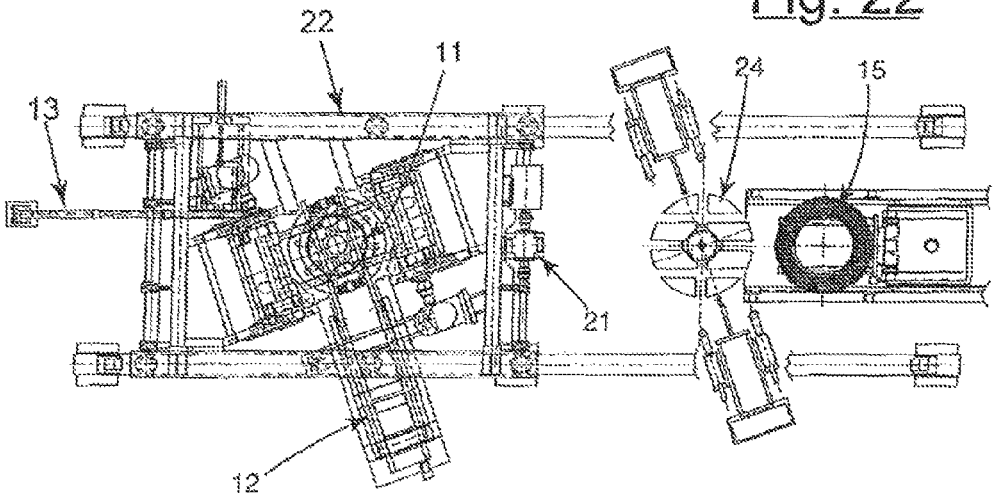

With reference to the drawings, the machine according to the invention includes a motorized spindle 10 for coiling that, as a non-limiting example, is closed at the top by a cover module 11 that is movable using a movement structure 12.

Said cover module 11 and said movement structure 12 are covered by the co-pending industrial patent application, filed simultaneously in Italy, by the same applicant, with the title: "Improved machine for winding a wire from a rolling mill into a coil" to which reference should be made if any clarification is required.

The head end C of the wire coming from the rolling mill is inserted into a seat provided in the spindle 10—in this example in the cover module 11, which rotates together with the spindle 10—by means of a threading unit 13 of a known type not described in detail.

Above the spindle 10 there is a pair of opposing forks 14 for lifting the coil 15 formed (FIGS. 23-29).

Each pair of forks 14 is connected pivotally at 16 to a frame 17, which can be commanded to move up and down (vertically) in the directions of the arrow 18.

The frame 17 is supported by an overhead crane 19 that can be moved forwards and backwards in the directions of the arrow 20 using a motor 21 beside an overhead-crane track structure 22.

With particular reference to FIGS. 23-29 of the drawings, according to the invention, between the arms of each fork 14 are fixed rollers 23 for containing the coil 15 formed, that can be commanded to act (press) on the outer layers of the coil, such as to hold it stably in position when lifting it from the spindle 10 and moving it to the binding station 24.

As is shown clearly in the drawings, each roller 23 is connected pivotally at 25 to one end of an angled arm 26, which at the other end is connected pivotally at 27 to the same frame 17 that supports the arms 14 of the forks.

Figure 27:
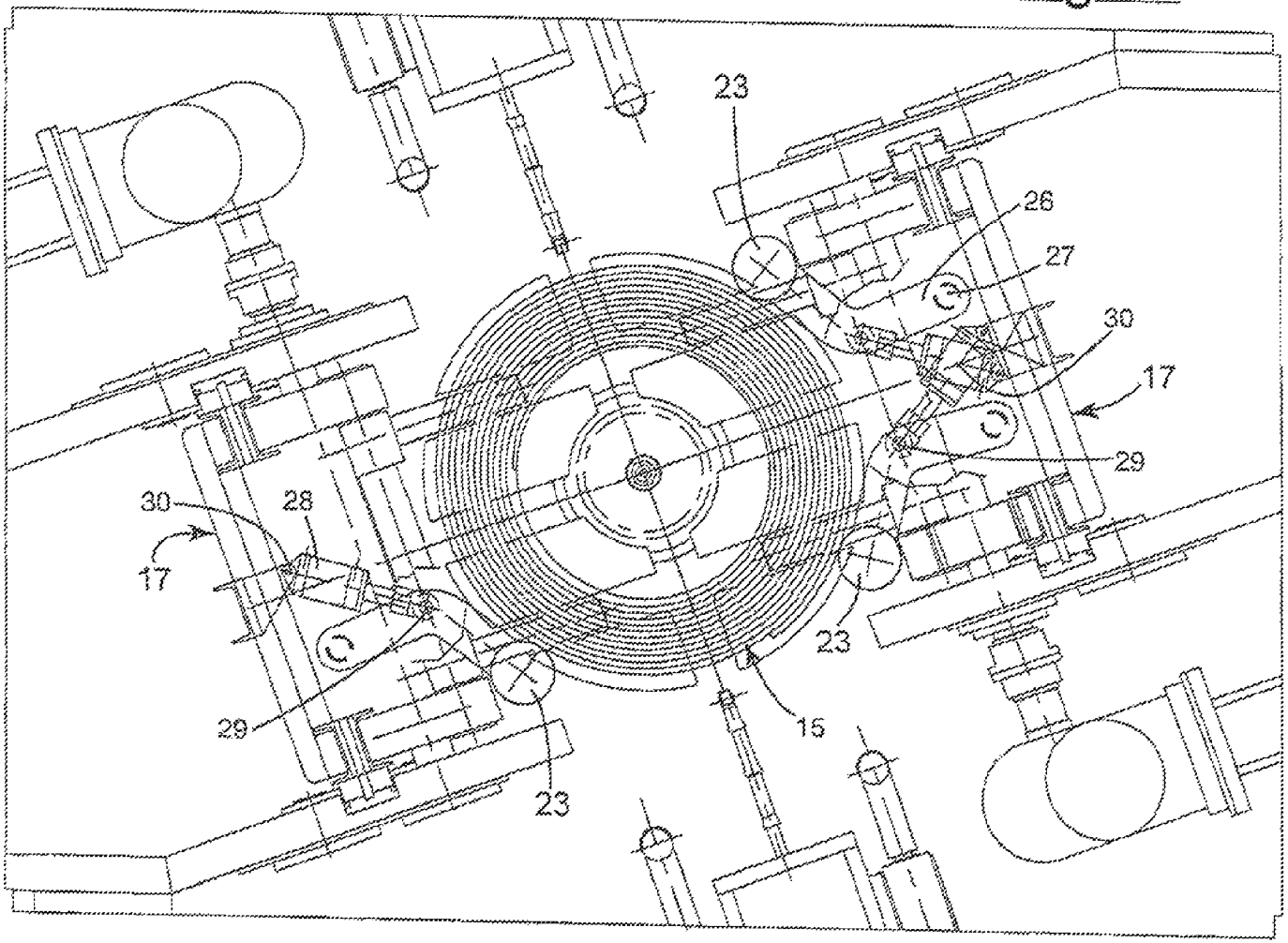
Figure 28:
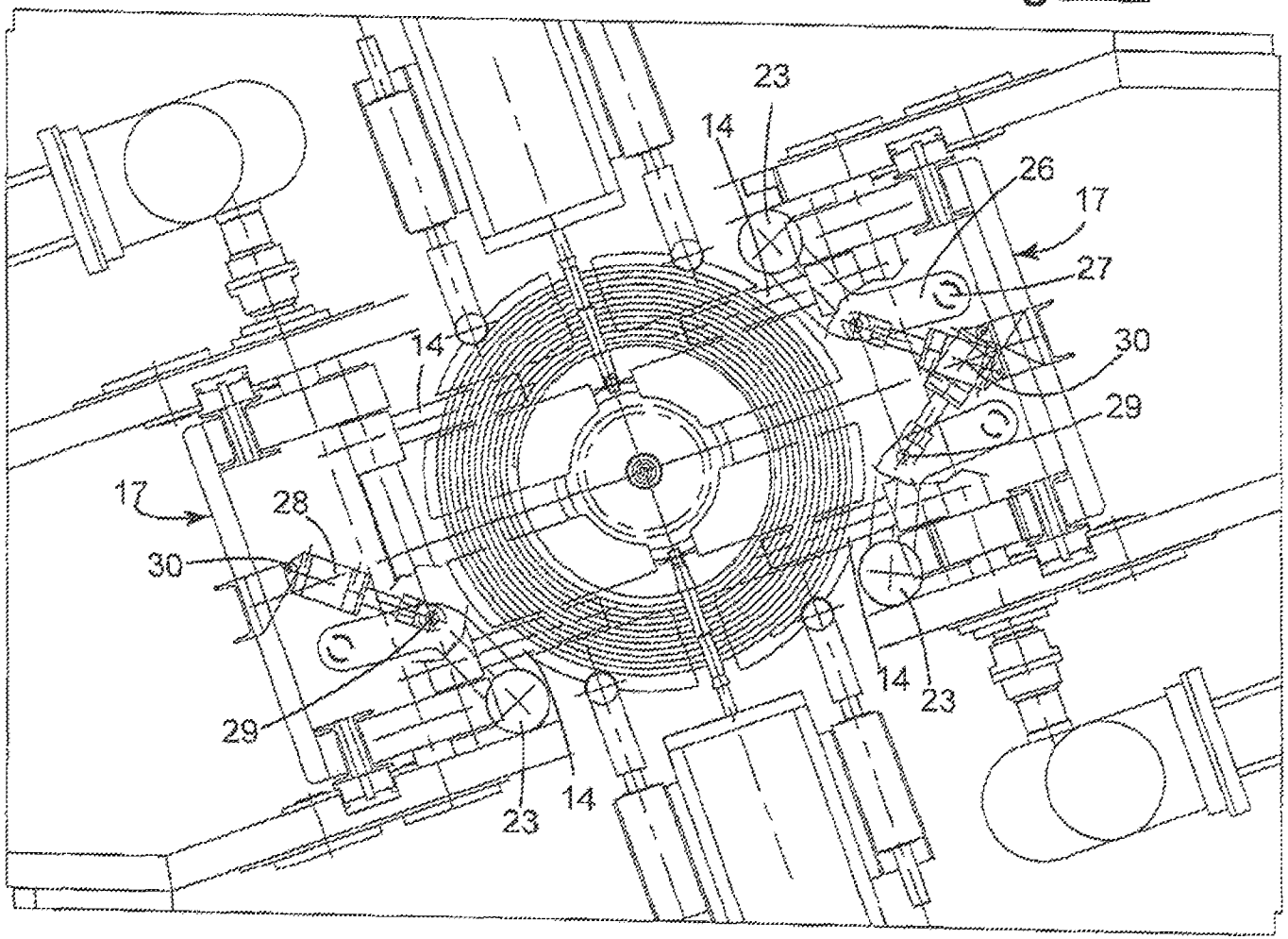

Each arm 26 is commanded to rotate around 27 by an actuator 28 (hydraulic cylinder) that is connected pivotally at 29 to the arm 26 and at 30 to the frame 17. In this way, the rollers 23 can be brought in contact with the sleeve 15 (FIGS. 24-27), and withdrawn from it (FIGS. 23, 28).

The aforementioned binding station 24 includes, in a known manner, a binding platform 34, on which is placed the coil 15 formed, two opposing binding units 31, provided with the respective coil-containment rollers 32, and a fork 33 for recovering the bound coil 15.

The operation of the machine according to the invention is clear and evident from the above description with reference to the figures, and can be summarized as follows.

Figure 23:
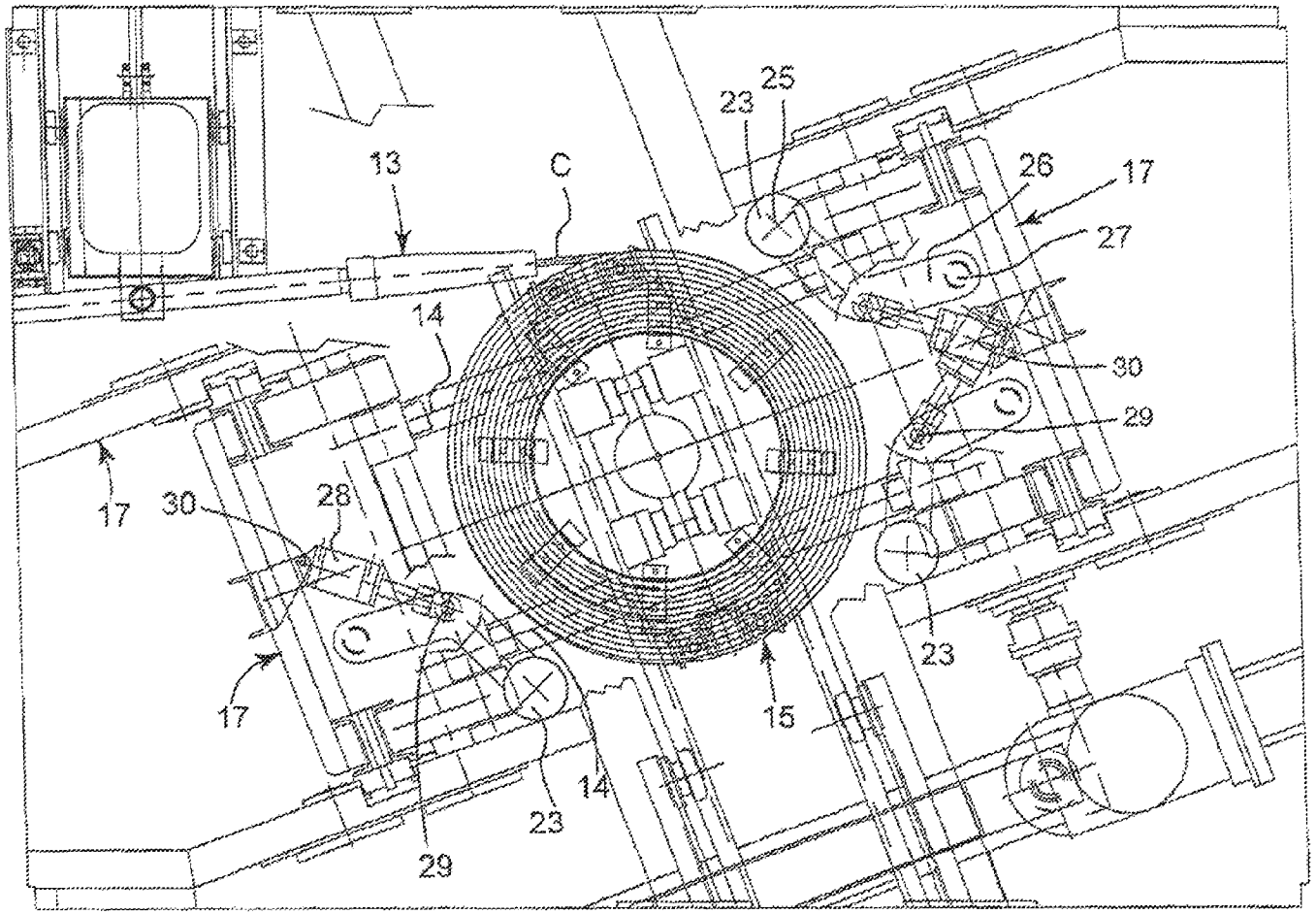
FIGS. 23-29 are enlarged plan views showing in greater detail the different operational phases of the machine according to the invention.

With reference to FIG. 23, the coil 15 still in winding phase, the lifting unit with open forks 14 is positioned at the level of the spindle 10 for winding the spindle 15. The coil containment rollers 23 are in the maximum open position.

Figure 24:
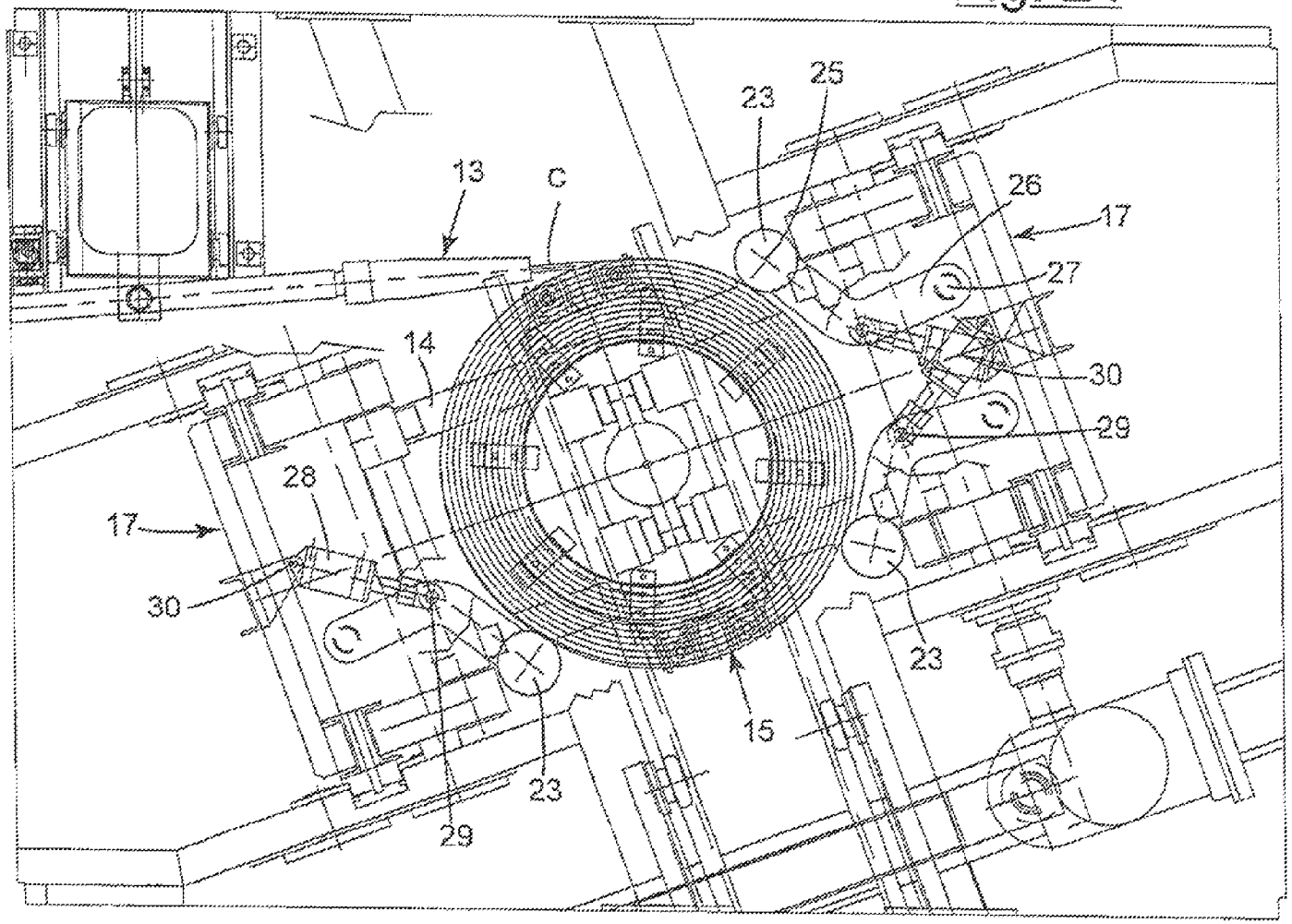

The containment rollers 23 begin the closing phase and come into contact with the coil 15 which is in the completion phase such as to contain the tail (FIG. 24).

Figure 25:
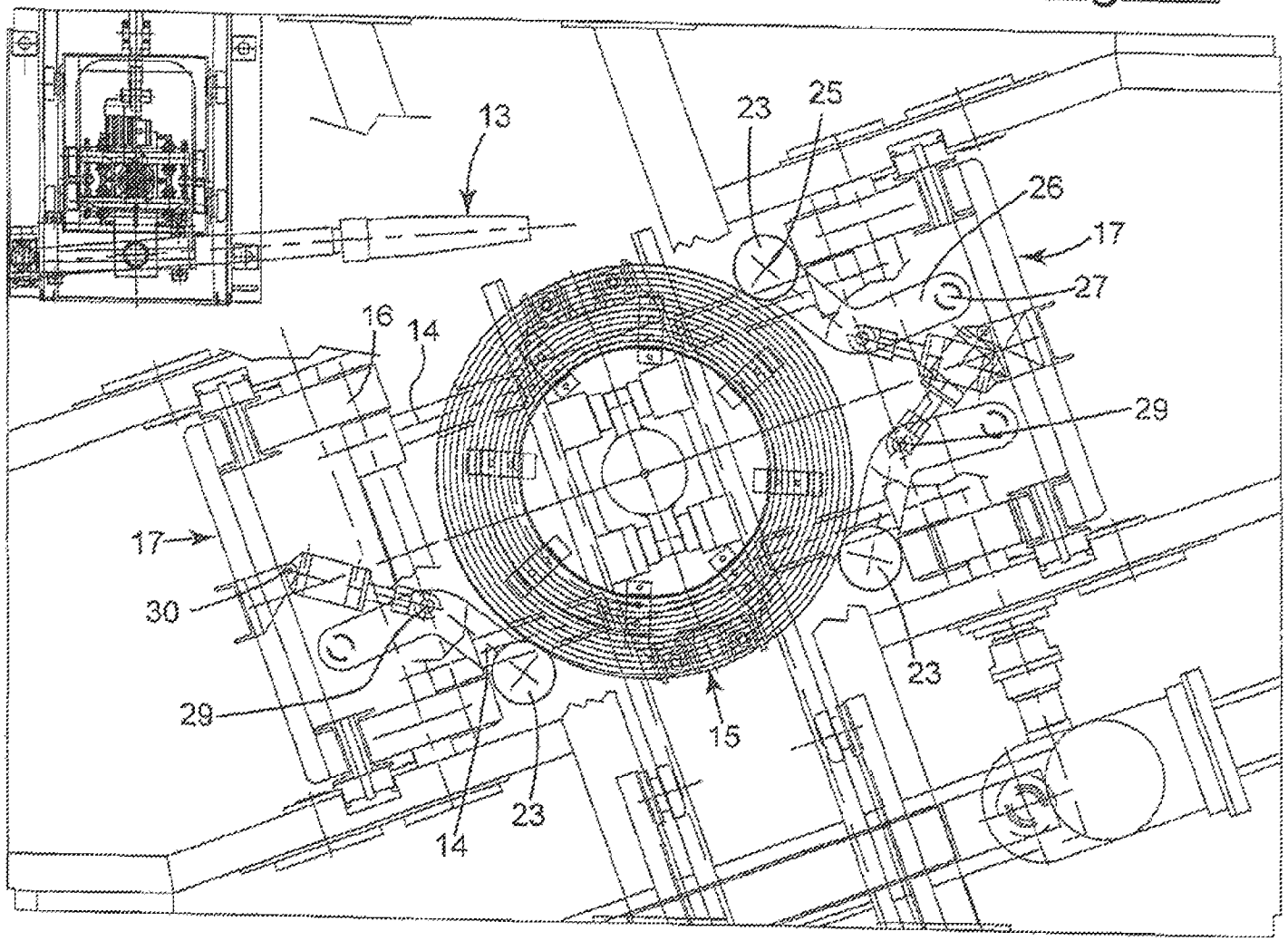
Figure 26:
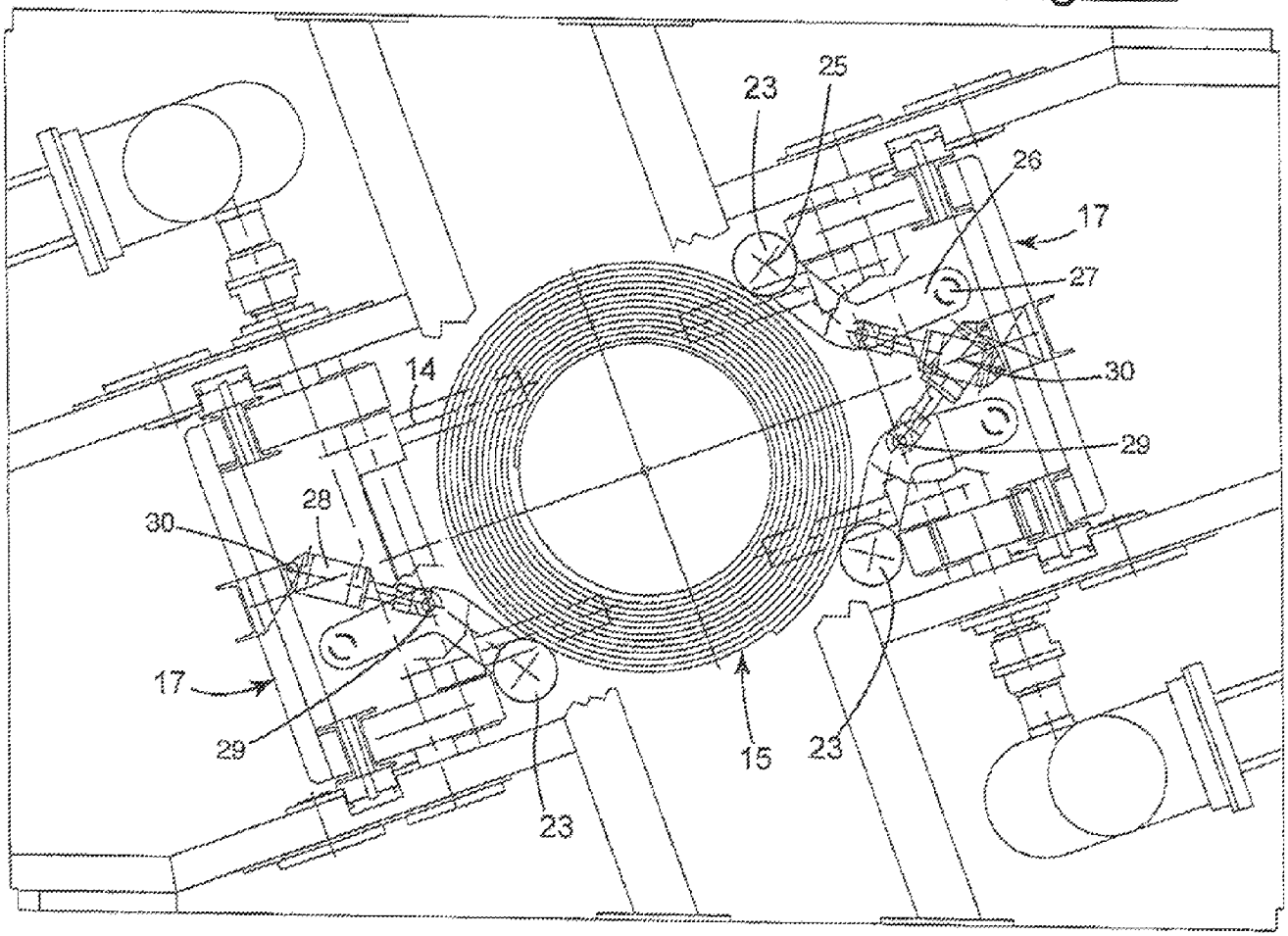

The threading unit 13 withdraws from the completed coil 15, the forks 14 close, while the rollers 23 remain in contact with the coil (FIG. 25). As shown in FIG. 26, the phase in which the wound coil is moved to the binding unit can then start, while the carrying truck is positioned on the binding platform (FIG. 27).

At this point (FIG. 28) the binders 31 and the respective containment rollers 32 are positioned for the binding phase. The containment rollers 23 and the forks 14 of the coil lifting unit open, and begin the ascent to reposition above the spindle 10 for winding a new coil.

Figure 29:
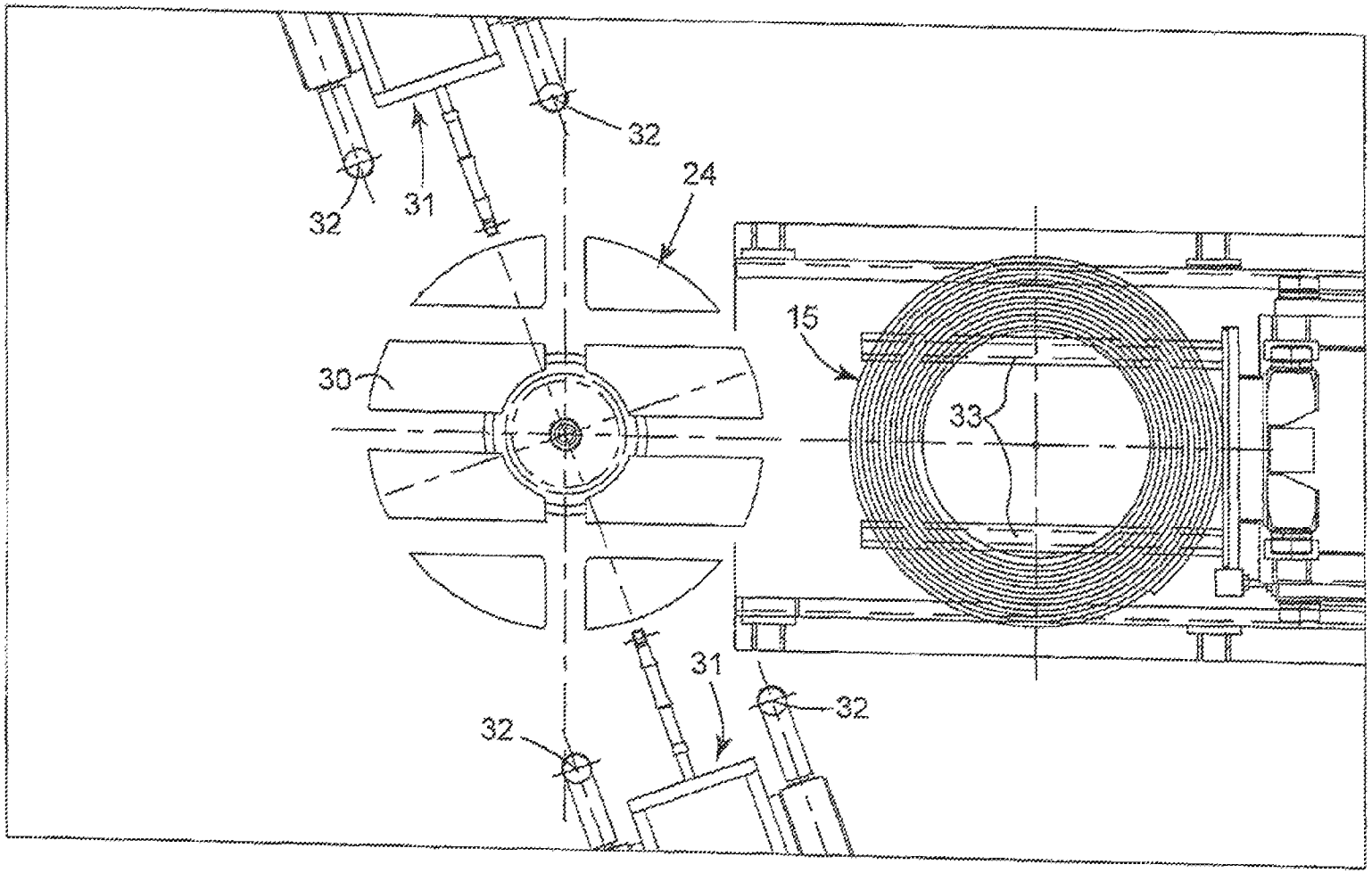

With reference to FIG. 29, the fork-lift truck 33 removes the bound coil from the binding platform 24 and moves it into storage.

This achieves the objectives mentioned in the introduction to the description for creating a machine for coiling a wire where the space around the winding spindle is entirely unencumbered.

Naturally the section of said wire may be circular (as shown by means of a non-limiting example) or a different shape, such as flat or angled or otherwise.

The scope of protection of the invention is defined in the following claims.

The invention claimed is:

1. A machine for winding a wire coming from a rolling mill into a coil, the machine comprising:

first means for locking a tail end of the wire; and second means for containing, lifting and moving a formed coil to a binding station;

said first means for locking the tail end of the wire and said second means for containing, lifting and moving the formed coil being built into a single operating unit.

2. The machine according to claim 1, wherein said first means for locking the tail end of the wire include a plurality of mobile rollers.

3. The machine according to claim 2, which further comprises:

a spindle for winding the coil;

said second means for containing, lifting and moving the formed coil including opposing mobile forks each having arms between which said rollers are mounted for containing the formed coil; and said rollers being configured to press against outer layers of the coil on demand to hold the coil stably in position when lifting the coil from said spindle and moving the coil to the binding station.

4. The machine according to claim 3, which further comprises:

a frame supporting said arms of said forks;

angled arms each having one end to which a respective one of said rollers is pivotally connected and another opposite end pivotally connected to said frame.

5. The machine according to claim 4, which further comprises actuators each being pivotally connected to a respective one of said angled arms and pivotally connected to said frame, for rotating said angled arms around said pivotal connection of said other opposite ends of said angled arms to said frame on demand.

6. The machine according to claim 1, wherein said second means for containing, lifting and moving the formed coil include opposing mobile forks.

7. The machine according to claim 6, which further comprises:

a frame configured to move up and down on demand;

an overhead-crane track structure;

an overhead crane moveable forwards and backwards on said overhead-crane track structure while supporting said frame; and a motor for moving said overhead crane on said overhead-crane track structure;

said opposing forks being pairs of forks connected pivotally to said frame.

8. The machine according to claim 1, wherein said first means for locking the tail end of the wire include a plurality of mobile rollers, and said second means for containing, lifting and moving the formed coil include opposing mobile forks between which said mobile rollers are placed.

9. The machine according to claim 1, which further comprises a frame to which said first means for locking the tail end of the wire and said second means for containing, lifting and moving the formed coil are connected.

10. A machine for winding a wire coming from a rolling mill into a coil, the machine comprising:

a locking device for locking a tail end of the wire;

a containing, lifting and moving device for containing, lifting and moving a formed coil to a binding station; and a frame;

said locking device and said containing, lifting and moving device being connected to said frame to form a single operating unit.

* * * * *